US011430362B2

(12) United States Patent
Okamoto

(10) Patent No.: US 11,430,362 B2
(45) Date of Patent: Aug. 30, 2022

(54) DISPLAY CONTROL DEVICE, DISPLAY CONTROL METHOD, AND NON-TRANSITORY RECORDING MEDIUM

(71) Applicant: SHARP KABUSHIKI KAISHA, Sakai (JP)

(72) Inventor: Takuya Okamoto, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 17/178,992

(22) Filed: Feb. 18, 2021

(65) Prior Publication Data

US 2021/0264835 A1 Aug. 26, 2021

(30) Foreign Application Priority Data

Feb. 21, 2020 (JP) ..... JP2020-028662

(51) Int. Cl.
*G09G 3/20* (2006.01)

(52) U.S. Cl.
CPC ..... *G09G 3/20* (2013.01); *G09G 2310/08* (2013.01); *G09G 2320/0646* (2013.01); *G09G 2330/023* (2013.01)

(58) Field of Classification Search
CPC .. A63F 2300/6081; H04N 2201/04774; H04N 9/3155; G09G 2300/0842; G09G 3/3233; G09G 2310/08; G09G 2320/0295; G09G 2330/023; G09G 2320/0646
See application file for complete search history.

(56) References Cited

U.S. PATENT DOCUMENTS 6,570,671 B1 * 5/2003 Yamaguchi ..... H04N 1/0443 358/1.16
2017/0186373 A1 * 6/2017 Nishikawa ..... G09G 3/3266
2018/0268765 A1 9/2018 Okamoto et al.

FOREIGN PATENT DOCUMENTS

JP 2006084758 A 3/2006
WO 2016/093125 A1 6/2016

* cited by examiner

*Primary Examiner* — Gerald Johnson
(74) *Attorney, Agent, or Firm* — ScienBiziP, P.C.

(57) ABSTRACT

A display control device for controlling a display panel that includes a light-emitting unit and that displays image data, the display control device comprises a light-emission control unit that controls a light-emission timing of the light-emitting unit; and an image-data update control unit that controls an update timing of the image data independently from the control of the light-emission timing.

15 Claims, 10 Drawing Sheets

DISPLAY CONTROL DEVICE, DISPLAY CONTROL METHOD, AND NON-TRANSITORY RECORDING MEDIUM

BACKGROUND

1. Field

The present disclosure relates to a display control device for controlling a display panel that includes a light-emitting unit and that displays image data.

2. Description of the Related Art

Known organic light-emitting diode (OLED) display devices for mobile use and display devices having light-emitting units, such as liquid-crystal display devices having backlights, have issues of flickering and so on. To this end, as illustrated in FIG. 9, image data is updated according to a vertical synchronization signal (VSYNC) for 60 Hz intervals.

However, for data update according to a vertical synchronization signal (VSYNC) for 60 Hz intervals, that is, for a 60 Hz drive frequency, there is a possibility that quick movements in moving images and so on cannot be supported, and the image quality decreases.

Thus, increasing the drive frequency from 60 Hz to 120 Hz, as illustrated in FIG. 10A, is conceivable to improve the image quality (e.g., to smoothly display moving-image video) in a display device. However, increasing the drive frequency from 60 Hz to 120 Hz doubles the number of drive operations, thus increasing power consumption. Also, when there is no update in image data, the drive frequency may be reduced from 120 Hz to 60 Hz, as illustrated in FIG. 10B, and frame thinning-out or the like may be performed to provide a period (a pause period) in which no data is transferred. This, however, can cause a decrease in display quality owing to flickering or the like. Accordingly, various technologies have been proposed in order to suppress an increase in power consumption and a decrease in display quality.

For example, International Publication No. 2016/093125 discloses a technology for a display control device that causes a display panel to display an image through switching between at least two types of frame rate. The display control device includes: an image-data update determining unit that determines whether or not there is an update in externally supplied image data in each pre-set image update period; and a first frame-rate setting unit that sets a frame rate in accordance with a determination result of the image-data update determining unit.

SUMMARY

International Publication No. 2016/093125 does not describe how to control a light-emitting unit in a display device. In this respect, for example, when drive for stopping light emission in a period (a pause period) in which no data is transferred is applied to International Publication No. 2016/093125, as illustrated in FIGS. 11, 12A and 12B, there is a possibility that the display quality decreases owing to flickering or the like. In display devices including light-emitting units, there are demands for a technology for suppressing a reduction in display quality while suppressing power consumption.

In view of the foregoing, it is desirable to provide a display control device that can realize both suppression of a reduction in display quality and a reduction in power consumption of a display device including a light-emitting unit.

According to one aspect of the disclosure, there is provided a display control device for controlling a display panel that includes a light-emitting unit and that displays image data. The display control device includes: a light-emission control unit that controls a light-emission timing of the light-emitting unit; and an image-data update control unit that controls an update timing of the image data independently from the control of the light-emission timing.

DESCRIPTION OF THE EMBODIMENTS

First Embodiment

Embodiments of the present disclosure will be described below in detail. A reciprocal of a cycle of updating image data is hereinafter referred to as a "frame rate", and a description will be given based on the premise that one aspect of the present disclosure is applicable to a variable frame-rate display device. In the present embodiment, a display device that performs video display by controlling an update timing of the image data through switching between double-speed drive in which the frame rate is 120 Hz and normal drive in which the frame rate is 60 Hz will be described by way of example.

(Display Device)

Figure 1:
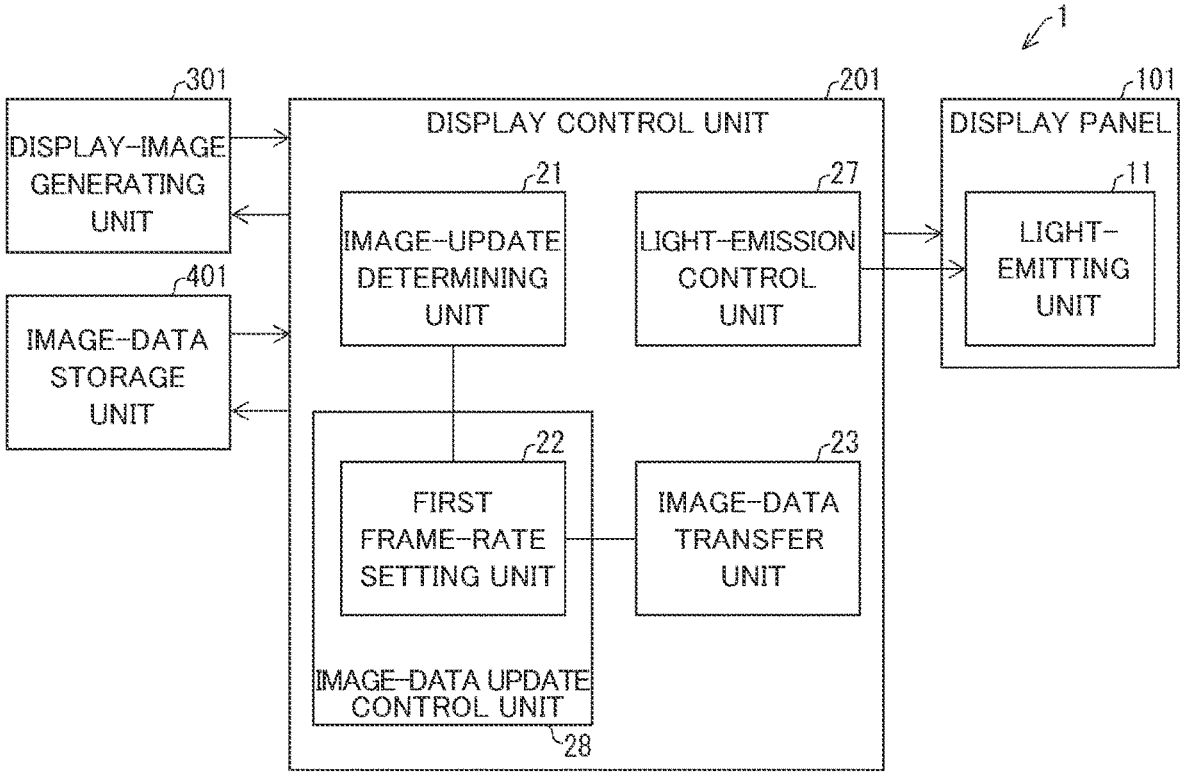
FIG. 1 is a block diagram illustrating a schematic configuration of a display device according to a first embodiment of the present disclosure.
Figure 2A:
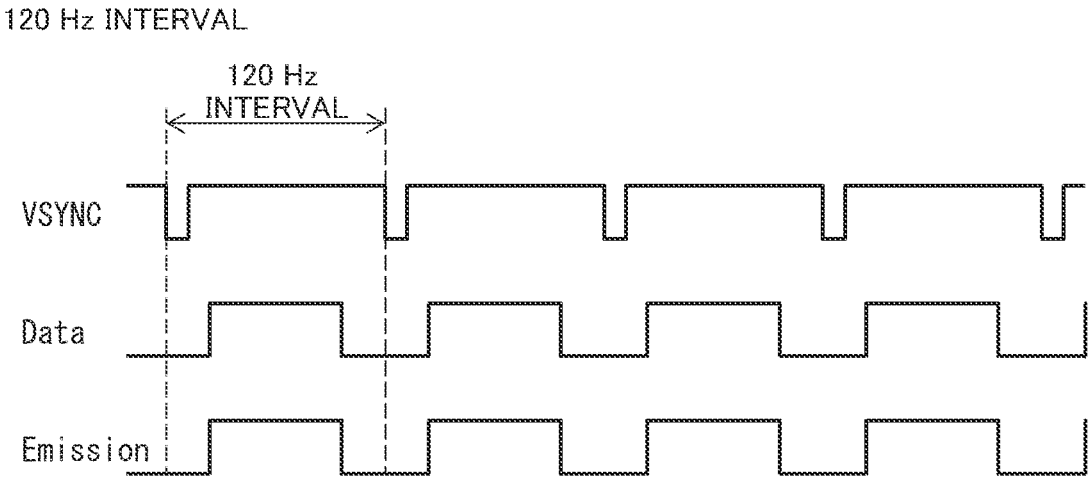
FIGS. 2A and 2B are timing charts illustrating image data update timings and light-emission timings in the display device illustrated in FIG. 1.
Figure 2B:
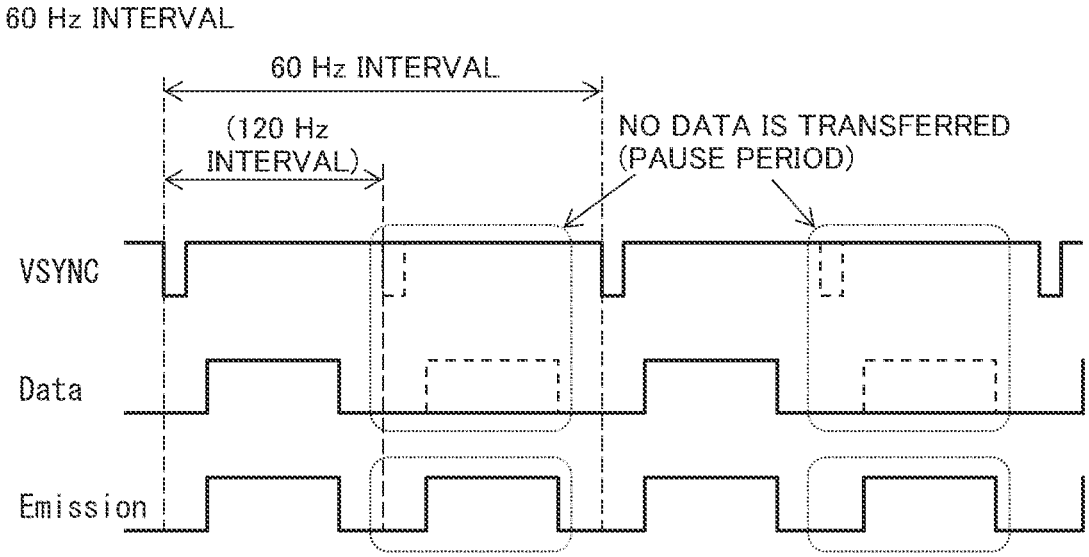

FIG. 1 is a block diagram illustrating a schematic configuration of a display device 1. FIGS. 2A and 2B are timing charts each illustrating an image data update timing and a light-emission timing in the display device 1 illustrated in FIG. 1.

As illustrated in FIG. 1, the display device 1 includes a display panel 101, a display control unit 201, a display-image generating unit 301, and an image-data storage unit 401.

The display panel 101 is a variable frame-rate display device that includes a light-emitting unit 11 and that displays images, such as still images and moving images. Examples of the display panel 101 include an OLED display panel and a liquid-crystal display panel having a backlight.

The display control unit 201 is a display control device that controls an update timing of image data by causing the display panel 101 to display video through switching of two types of frame rate (120 Hz and 60 Hz). The display control unit 201 is also a display control device that controls a light-emission timing of the light-emitting unit 11 independently from the update timing of the image data.

The display-image generating unit 301 generates image data to be displayed on the display panel 101, based on image signals received externally, and transfers the image data to the display control unit 201.

The image-data storage unit 401 temporarily stores therein the image data that the display control unit 201 receives from the display-image generating unit 301. The display control unit 201 also reads the stored image data, as appropriate. That is, the image-data storage unit 401 is a video random access memory (VRAM) that temporarily stores therein the image data that is supplied from the display-image generating unit 301 and that is to be transferred to the display panel 101.

The display control unit 201 includes: an image-update determining unit (an image-data update determining unit) 21 that determines whether or not there is an update in image data in each pre-set image-update determination period; an image-data update control unit 28 that controls the update timing of the image data independently from control of the light-emission timing of the light-emitting unit 11; an image-data transfer unit 23 that generates a vertical synchronization signal (VSYNC) in accordance with a frame rate set by a first frame-rate setting unit 22 and that transfers image data stored in the image-data storage unit 401 to the display panel 101 at a timing according to the generated VSYNC; and a light-emission control unit 27 that controls the light-emission timing of the light-emitting unit 11 independently from the update timing of the image data. The image-data update control unit 28 includes the first frame-rate setting unit 22 that sets the frame rate in accordance with a determination result of the image-update determining unit 21.

That is, the first frame-rate setting unit 22 in the display control unit 201 sets the frame rate in accordance with the determination result of whether or not there is an update in the image data, the update being performed in each pre-set image-update determination period. The first frame-rate setting unit 22 also generates a display update timing in accordance with the set frame rate. The image-data transfer unit 23 in the display control unit 201 is adapted to transfer the image data to the display panel 101 at the generated timing.

In this case, the image-update determination period in the present embodiment is assumed to be 120 Hz. That is, in the present embodiment, the determination as to whether or not there is an update in the image data is adapted to be made at 120 Hz intervals. This image-update determination period is not limited to 120 Hz and may be 60 Hz or another frequency.

In the first frame-rate setting unit 22 in the display control unit 201, a normal display update timing is set to 120 Hz, which is used for double-speed drive illustrated in FIG. 2A. When high performance is not needed or there is no display update, the first frame-rate setting unit 22 sets the display update timing to 60 Hz, which is used for normal drive illustrated in FIG. 2B. In this case, the 60 Hz display update timing illustrated in FIG. 2B is realized by thinning out frames at the 120 Hz display update timing. Specifically, one frame is thinned out from each of the 120 Hz data-transfer intervals illustrated in FIG. 2A to provide a period (a pause period) in which no data is transferred, as illustrated in FIG. 2B, to thereby realize 60 Hz data-transfer intervals, that is, the 60 Hz display update timing.

For example, when no image data is transferred from the display-image generating unit 301 at a predetermined timing, the image-data transfer unit 23 in the display control unit 201 determines that there is no image update, reads the image data already stored in the image-data storage unit 401, and transfers the image data to the display panel 101, as appropriate. In this case, upon determining that high performance is not needed or a display update is not needed, the image-data transfer unit 23 in the display control unit 201 sets a pause period, as illustrated in FIG. 2B, to temporarily suspend the transfer of the image data to the display panel 101, thereby reducing the frame rate from 120 Hz to 60 Hz.

The determination as to whether or not there is an image update may be determined based on whether or not there is an update in the image data stored in the image-data storage unit 401.

When high performance is needed and/or there is a display update, the frame rate is set to a large value, such as 120 Hz, to thereby make it possible to smoothly display moving-image video. In the above-described example, the update timing of the image data is controlled independently from the control of the light-emission timing. This allows a pause period to be provided at the update timing even in an OLED display device and a liquid-crystal display device, other than an oxide semiconductor liquid-crystal device as in the related art. As a result, when high performance is not needed or there is no display update, reducing the frame rate or providing the pause period makes it possible to reduce the power consumption, compared with a case in which the frame rate is set high at all times.

The light-emission control unit 27 in the display control unit 201 controls the light-emission timing of the light-emitting unit 11 so as to cause the light-emitting unit 11 in the display panel 101 to emit light at a predetermined cycle independently from the control of the update timing of the image data. For example, as illustrated in FIGS. 2A and 2B, the light-emission control unit 27 causes the light-emitting unit 11 to emit light at a cycle of 120 Hz intervals, regardless of whether or not the frame rate decreases from 120 Hz to 60 Hz. Thus, the light-emission control unit 27 controls the light-emission timing so as to cause the light-emitting unit 11 in the display panel 101 to emit light even in each pause period, which is a period in which a frame is thinned out and no data is transferred, as illustrated in FIG. 2B, that is, at a timing at which there is no update in the image data. As a result, even when the display panel 101 is a spontaneous light-emitting display, such as an OLED, having a display quality that deteriorates when the light emission cycle varies even a little, the display quality can be ensured.

Although, in the above-described example, the light-emission control unit 27 causes the light-emitting unit 11 in the display panel 101 to emit light at the 120 Hz cycle, which is the same as the frame rate of a highest-speed drive (double-speed drive), the present embodiment is not limited thereto. In the present embodiment, the light-emission control unit 27 may cause the light-emitting unit 11 in the display panel 101 to emit light, for example, at a 240 Hz cycle or the like that is greater than the frame rate of the highest-speed drive. In the present embodiment, the light-emission control unit 27 may cause the light-emitting unit 11 in the display panel 101 to emit light at all times.

(Display Control Processing: Display Control Method)

Display control processing in the display control unit 201 having the above-described configuration will be described below with reference to the flowchart illustrated in FIG. 3. The normal frame rate of the display device 1 is assumed to be 120 Hz, and when high performance is not needed or there is no image update, the frame rate is assumed to be reduced from 120 Hz to 60 Hz. Accordingly, in the present embodiment, the upper-limit value of the frame rate is 120 Hz.

First, the image-update determining unit 21 in the display control unit 201 determines whether or not there is an update in an image (an update in image data) (S11). Upon determining that there is an update in the image, the image-update determining unit 21 causes the display-image generating unit 301 to generate image data for display (S12) and transfers the image data to the display control unit 201 (S13).

Next, the image-update determining unit 21 in the display control unit 201 stores the image data, transferred from the display-image generating unit 301, in the image-data storage unit 401 (S14).

Subsequently, the image-data transfer unit 23 in the display control unit 201 generates a display timing (VSYNC) (S16). In this case, since the image-update determining unit 21 determined in S11 that there is an update in the image, the image-data transfer unit 23 generates a display timing (VSYNC) with which display update can be performed at intervals of the 120 Hz frame rate set by the first frame-rate setting unit 22.

Next, the image-data transfer unit 23 in the display control unit 201 reads the image data, stored in the image-data storage unit 401, at the generated display timing (S17) and transfers the image data to the display panel 101 (S18). The display panel 101 displays the image data transferred from the display control unit 201 (S19).

On the other hand, when the image-update determining unit 21 in the display control unit 201 determines that there is no update in the image in 311, the process proceeds to S15.

In S15, the first frame-rate setting unit 22 in the display control unit 201 receives a signal indicating that there is no image update from the image-update determining unit 21 and determines whether or not the transfer of the image data is to be temporarily suspended. In this case, "temporarily suspending the transfer of the image data" means setting the pause period described above and illustrated in FIG. 2B.

The suspension determination in S15 is made, for example, by checking whether or not the image display is being performed using a previous frame. For example, the checking as to whether or not the image display is being performed using the previous frame may be performed according to whether or not the image data stored in the image-data storage unit 401 has been updated or may be performed according to whether or not the image data is transferred from the display-image generating unit 301 at a predetermined timing (an image-data update determining process). That is, when the image data has been updated, it is determined that the image display is being performed using the previous frame. Accordingly, when the image data has been updated, the image display is being performed using the previous frame, it is thus determined that the transfer of the image data is to be temporarily suspended (Yes in S15), and the processing ends. Thus, when the transfer is temporarily suspended, the 60 Hz update illustrated in FIG. 2B is performed (a frame-rate setting process).

On the other hand, when no image display is being performed using the previous frame (No in S15), the process proceeds to S16 in order to perform display update on the display panel 101. In S16, a display timing is generated, and a process that is the same as the process for a case in which there is an image update in S11 is executed.

When it is determined that the image has been updated, as described above, processing that is normally updated at 120 Hz is updated at 60 Hz. This makes it possible to reduce the power consumption, compared with a case in which 120 Hz update is performed at all times.

The light-emission control unit 27 in the display control unit 201 controls the light-emission timing of the light-emitting unit 11 in the display panel 101 independently from the control of the update timing of the image data, the control being performed by the first frame-rate setting unit 22. In this case, the light-emission control unit 27 in the display control unit 201 causes the light-emitting unit (a display element) 11 in the display panel 101 to emit light at a predetermined cycle (at regular intervals) (S20), regardless of whether or not there is an image update in step S11 in FIG. 3.

Figure 3:
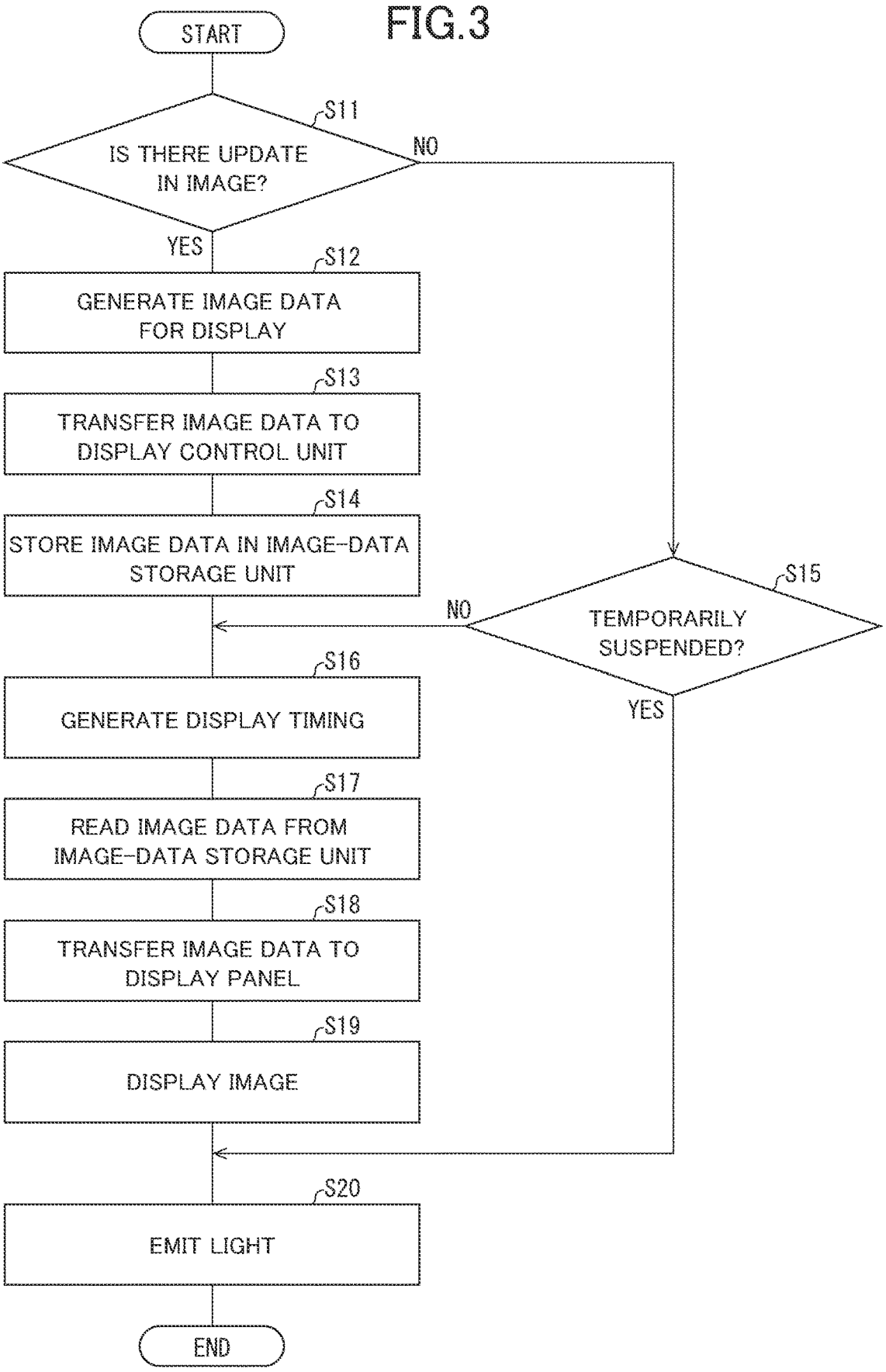
FIG. 3 is a flowchart illustrating a flow of display control processing in the display device illustrated in FIG. 1.

Although the light-emission control unit 27 is described as causing the light-emitting unit 11 in the display panel 101 to emit light in S20, which is the last step in FIG. 3, the present embodiment is not limited thereto. In the present embodiment, since the light-emission timing of the light-emitting unit 11 in the display panel 101 is controlled independently from the control of the update timing of the image data, the light-emission control unit 27 may cause the light-emitting unit 11 to emit light before the image display in S19.

(Effects and Advantages)

In the display device 1 having the above-described configuration, when the image-update determining unit 21 determines that there is no image update, the first frame-rate setting unit 22 is adapted to set the frame rate to the frame rate (60 Hz), which is lower than the frame rate (120 Hz) at the time of the previous image-update determination.

Accordingly, when it is determined that there is no image update, the frame rate is changed to the frame rate (60 Hz), which is lower than the frame rate (120 Hz) at the time of the previous image-update determination, thus making it possible to reduce the power consumption, compared with a case in which the frame rate is 120 Hz.

In the display device 1 having the above-described configuration, the light-emission control unit 27 controls the light-emission timing of the light-emitting unit 11 independently from the control of the update timing of the image data so that the light-emitting unit 11 in the display panel 101 emits light at a predetermined cycle. Thus, the light-emission control unit 27 controls the light-emission timing so as to cause the light-emitting unit 11 in the display panel 101 to emit light even in each pause period, which is a period in which a frame is thinned out and no data is transferred, that is, at a timing at which there is no update in the image data. As a result, even when the display panel 101 is a spontaneous light-emitting display, such as an OLED, having a display quality that deteriorates when the light emission cycle varies even a little, the display quality can be ensured.

Although an example in which the frame rate changes between 120 Hz and 60 Hz has been described above, the present disclosure is by no means limited thereto, and the frame rate can be set in an arbitrary range in which the display device can operate. That is, in the present embodiment, the upper-limit value and the lower-limit value of the frame rate can be set in an arbitrary range in which the display device can operate. For example, although the upper-limit value of the frame rate is 120 Hz in the above description, the upper-limit value of the frame rate in the present embodiment may be 240 Hz, 360 Hz, or a value larger than these values. Although the lower-limit value of the frame rate is 60 Hz in the above description, the lower-limit value of the frame rate in the present embodiment may be 1 Hz, 0.1 Hz, or a value smaller than these values.

For example, for an OLED display device in which the frame rate can be changed in the range of 120 Hz to 30 Hz, the upper-limit value and the lower-limit value of the frame rate can be set in the range of 120 Hz to 30 Hz. Also, for example, for a liquid-crystal display device in which the frame rate can be changed in the range of 120 Hz to 1 Hz, the upper-limit value and the lower-limit value of the frame rate can be set in the range of 120 Hz to 1 Hz.

Second Embodiment

Another embodiment of the present disclosure will be described below. For convenience of description, members having substantially the same functions of the members described above in the first embodiment are denoted by the same reference numbers, and descriptions thereof are not given below.

(Display Device)

Figure 4:
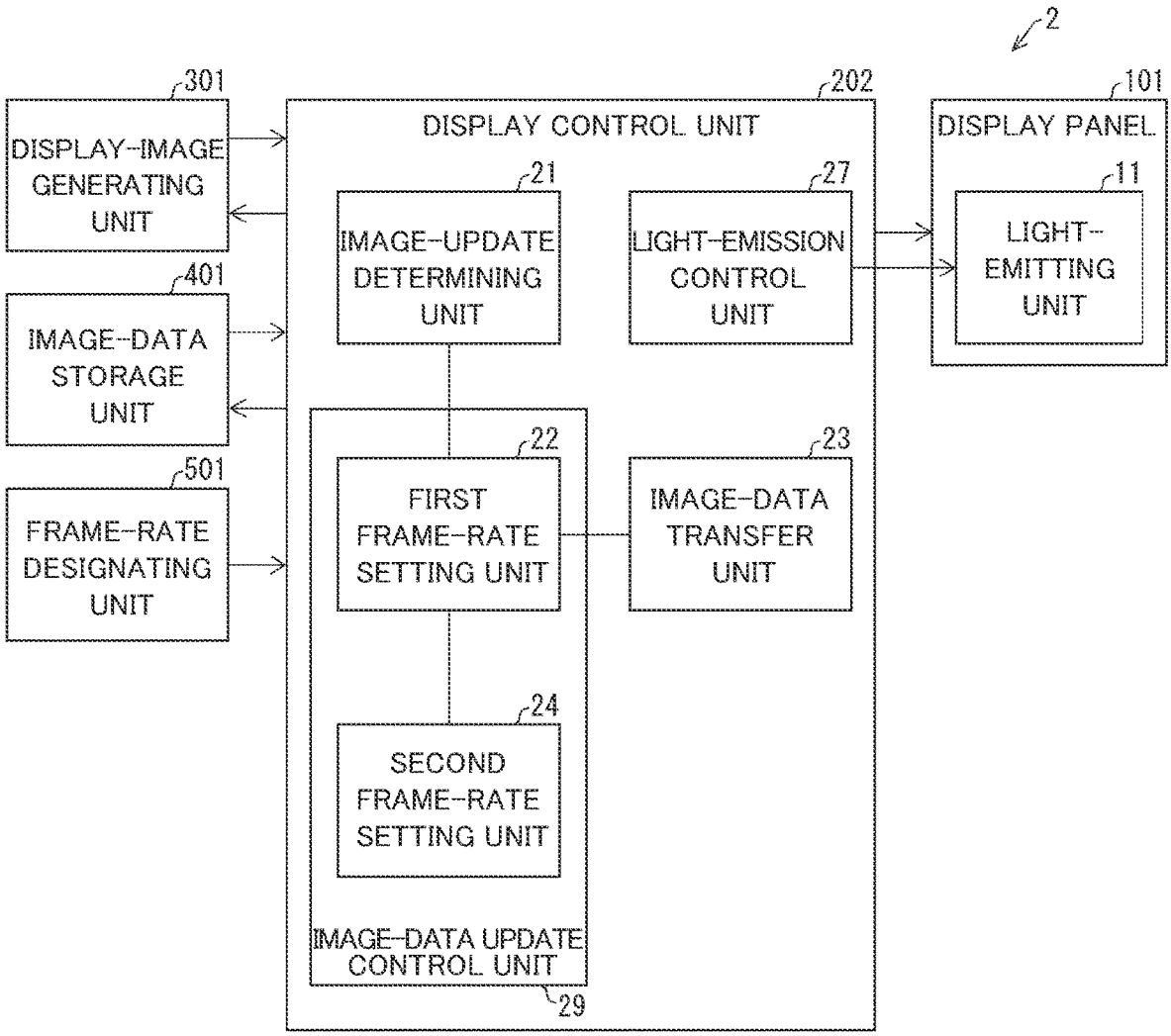
FIG. 4 is a block diagram illustrating a schematic configuration of a display device according to a second embodiment of the present disclosure.

FIG. 4 is a block diagram illustrating a schematic configuration of a display device 2 according to the present embodiment. The display device 2 has a configuration in which a frame-rate designating unit 501 is added to the configuration of the display device 1 illustrated in FIG. 1 and that includes a display control unit 202 instead of the display control unit 201 illustrated in FIG. 1. The frame-rate designating unit 501 allows a user to designate a frame rate. The display control unit 202 has a configuration in which a second frame-rate setting unit 24 that sets an upper-limit value of the frame rate designated by the user by using the frame-rate designating unit 501 is added to the configuration of the image-data update control unit 28 in the display control unit 201.

The frame-rate designating unit 501 is adapted to allow the user to select the frame rate of, for example, 120 or 60 Hz and is adapted to send the selected frame rate to the second frame-rate setting unit 24 in an image-data update control unit 29 in the display control unit 202.

When the frame rate sent from the frame-rate designating unit 501 is 60 Hz, the second frame-rate setting unit 24 sends 60 Hz to the first frame-rate setting unit 22 as the upper-limit value of the frame rate.

Also, when the frame rate sent from the frame-rate designating unit 501 is 120 Hz, the second frame-rate setting unit 24 sends 120 Hz to the first frame-rate setting unit 22 as the upper-limit value of the frame rate.

That is, when the second frame-rate setting unit 24 sets the upper-limit value of the frame rate, the first frame-rate setting unit 22 sets an upper-limit value of the frame rate to be set by the first frame-rate setting unit 22 to the upper-limit value set by the second frame-rate setting unit 24.

(When Frame Rate of 60 Hz is Selected by User)

The second frame-rate setting unit 24 instructs the first frame-rate setting unit 22 so as to set the upper-limit value of the frame rate to 60 Hz, and the first frame-rate setting unit 22 instructs the image-data transfer unit 23 so as to transfer image data to the display panel 101 so that the frame rate does not exceed 60 Hz.

The frame rate that can be set by the user is not necessarily fixed to 120 or 60 Hz and can be set to any frame rate at which the display device can operate.

In this case, the image-data transfer unit 23 can determine the timing of transferring the image data to the display panel 101, that is, the display timing. The update timing of image generation performed by the display-image generating unit 301 also complies with the display timing (VSYNC). Accordingly, the image-data transfer unit 23 transfers the image data to the display panel 101 at the generated display timing.

Specifically, the falling and the rising of the display timing (VSYNC) generated by the image-data transfer unit 23 are stopped once every two times, so that the display-image generating unit 301 also performs image generation at 60 Hz intervals, as illustrated in FIG. 2B, to make it possible to perform pause driving.

(When Frame Rate of 120 Hz is Selected by User)

In this case, the image-data transfer unit 23 sets the upper limit of the display timing to 120 Hz. Thus, when image update is continuously performed, the image data is continuously transferred to the display panel 101 at 120 Hz.

Since the frame rate designated by the user by using the frame-rate designating unit 501 is set for the upper-limit value of the frame rate set by the first frame-rate setting unit 22, as described above, there is an advantage in that the image display can be performed at a frame rate according to the user's request.

Although, in the present embodiment, the upper-limit value of the frame rate is set by the user in addition to the first embodiment in order to meet the user's request, the upper-limit value of the frame rate may also be set according to remaining battery charge, as in a third embodiment described below.

Third Embodiment

Another embodiment of the present disclosure will be described below. For convenience of description, members having substantially the same functions of the members described above in the first and second embodiments are denoted by the same reference numbers, and descriptions thereof are not given below.

(Display Device)

Figure 5:
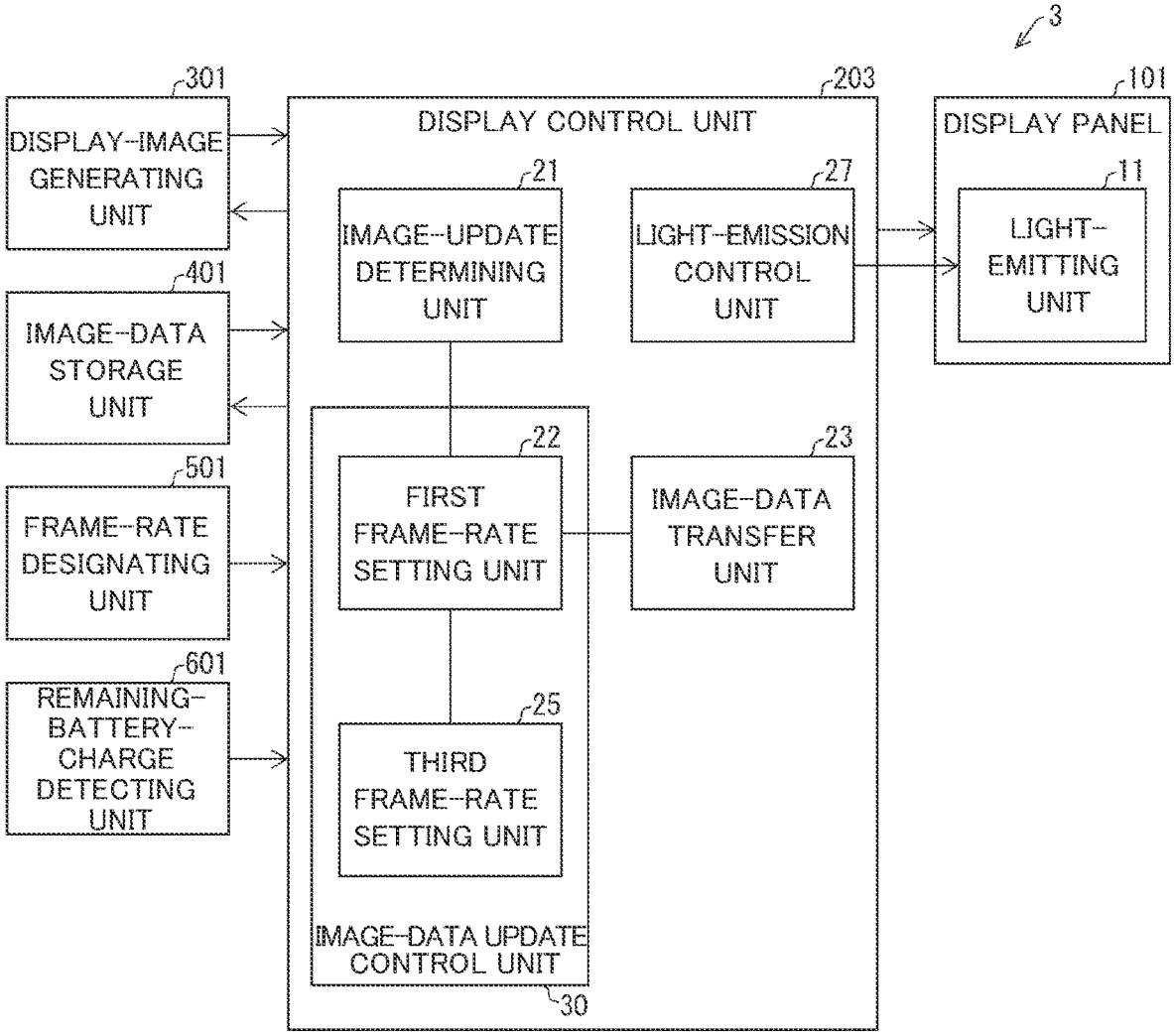
FIG. 5 is a block diagram illustrating a schematic configuration of a display device according to a third embodiment of the present disclosure.

FIG. 5 is a block diagram illustrating a schematic configuration of a display device 3 according to the present embodiment. The display device 3 has a configuration in which a remaining-battery-charge detecting unit (a remaining-battery-charge checking unit) 601 is added to the configuration of the display device 2 illustrated in FIG. 4 and that includes a display control unit 203 instead of the display control unit 202 illustrated in FIG. 4. The remaining-battery-charge detecting unit 601 detects (checks) remaining battery charge of the display device 3. The display control unit 203 has a configuration in which a third frame-rate setting unit 25 that sets an upper-limit value of the frame rate according to a detection result (the remaining battery charge) of the remaining-battery-charge detecting unit 601 is added to the configuration of the image-data update control unit 29 in the display control unit 202.

When the third frame-rate setting unit 25 in an image-data update control unit 30 sets the upper-limit value of the frame rate, the upper-limit value of the frame rate to be set by the first frame-rate setting unit 22 is set to the upper-limit value set by the third frame-rate setting unit 25.

That is, when the third frame-rate setting unit 25 sets the upper-limit value of the frame rate, the first frame-rate setting unit 22 sets an upper-limit value of the frame rate to be set by the first frame-rate setting unit 22 to the upper-limit value set by the third frame-rate setting unit 25.

(Frame-Rate Setting Processing)

Figure 6:
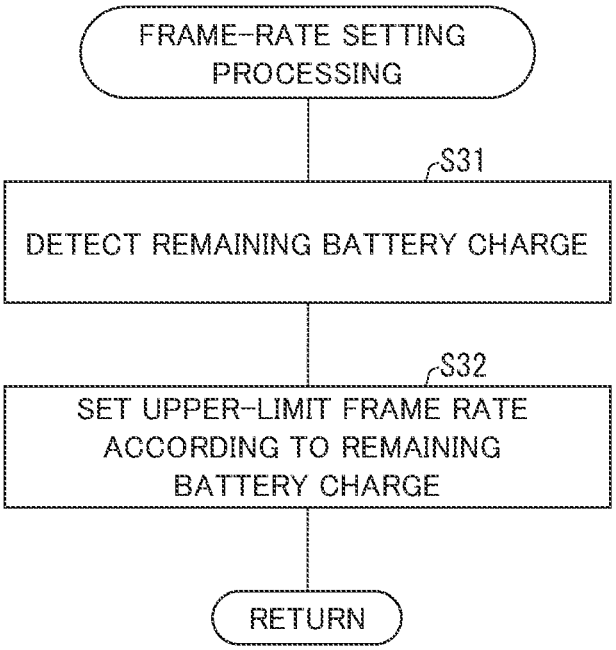
FIG. 6 is a flowchart illustrating a flow of frame-rate setting processing in the display device illustrated in FIG. 5.

FIG. 6 is a flowchart illustrating a flow of frame-rate setting processing in the third frame-rate setting unit 25 in the display device 3 illustrated in FIG. 5. The frame-rate setting processing is assumed to be executed before the first step (S11) in the flowchart (FIG. 3) used in the description of the first embodiment is performed.

The third frame-rate setting unit 25 detects remaining battery charge from a signal sent from the remaining-battery-charge detecting unit 601 (S31) and sets an upper-limit frame rate according to the detected remaining battery charge (S32).

Although a target that is checked for the remaining battery charge in the present embodiment is a battery of the display device 3, the target is not limited thereto and may be a battery of electronic equipment including the display control unit 203.

Although, in the present embodiment, the upper-limit value of the frame rate is set according to the remaining battery charge in addition to the second embodiment, the upper-limit value of the frame rate in a fourth embodiment described below may be set for each application to be executed.

Fourth Embodiment

Another embodiment of the present disclosure will be described below. For convenience of description, members having substantially the same functions of the members described above in the first to third embodiments are denoted by the same reference numbers, and descriptions thereof are not given below.

(Display Device)

Figure 7:
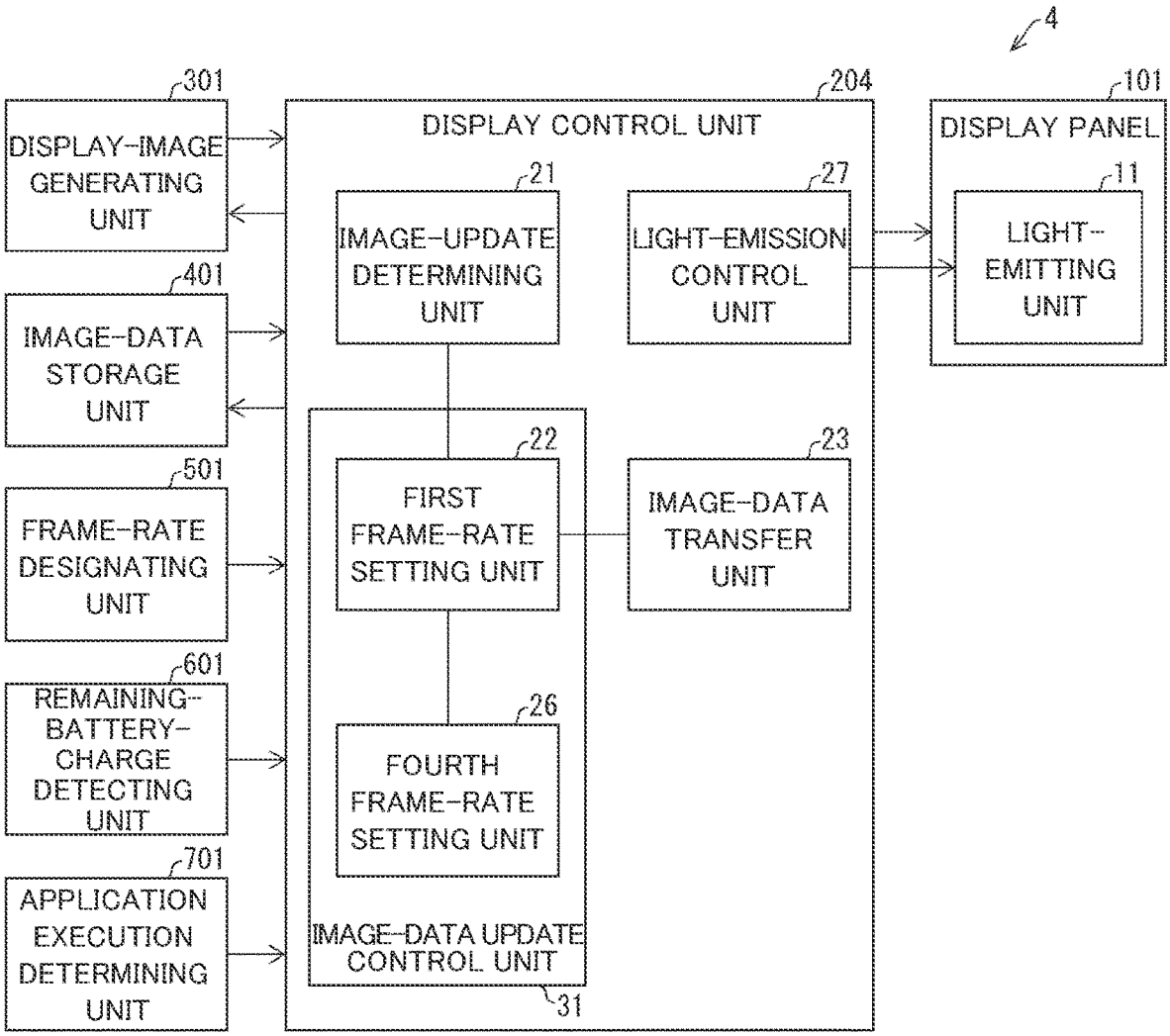
FIG. 7 is a block diagram illustrating a schematic configuration of a display device according to a fourth embodiment of the present disclosure.

FIG. 7 is a block diagram illustrating a schematic configuration of a display device 4 according to the present embodiment. A description in the present embodiment will be given of a case in which the display device 4 is included in a portable information terminal, such as a smartphone, that can execute an application.

The display device 4 has a configuration in which an application execution determining unit 701 is added to the configuration of the display device 3 illustrated in FIG. 5 and that includes a display control unit 204 instead of the display control unit 203 illustrated in FIG. 5. The application execution determining unit 701 determines an application to be executed. The display control unit 204 has a configuration in which a fourth frame-rate setting unit 26 that sets an upper-limit value of the frame rate in accordance with a determination result of the application execution determining unit 701 is added to the configuration of the image-data update control unit 30 in the display control unit 203. In this configuration, the application execution determining unit 701 transmits an identification signal for an application that is executed to the display control unit 204 as the determination result.

The fourth frame-rate setting unit 26 in an image-data update control unit 31 has a table in which the application that is executed and the upper-limit value of the frame rate are associated with each other. Upon receiving an identification signal for identifying the application that is executed, the fourth frame-rate setting unit 26 refers to the table to set the upper-limit value of the frame rate, and the first frame-rate setting unit 22 sets an upper-limit value of the frame rate to be set thereby to the upper-limit value set by the fourth frame-rate setting unit 26.

That is, the first frame-rate setting unit 22 sets the upper-limit value of the frame rate in accordance with an application that is executed by the application execution determining unit 701.

(Frame-Rate Setting Processing)

Figure 8:
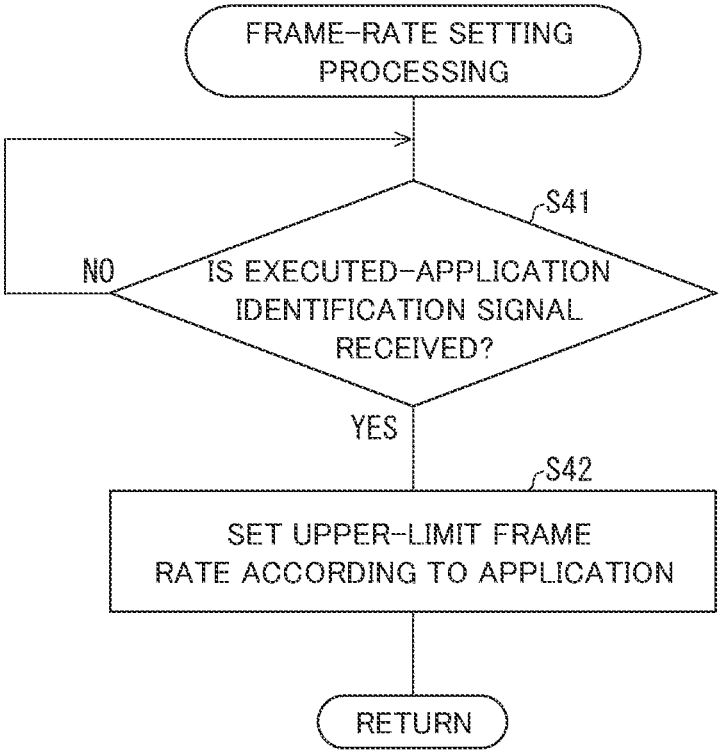
FIG. 8 is a flowchart illustrating a flow of frame-rate setting processing in the display device illustrated in FIG. 7.
Figure 9:
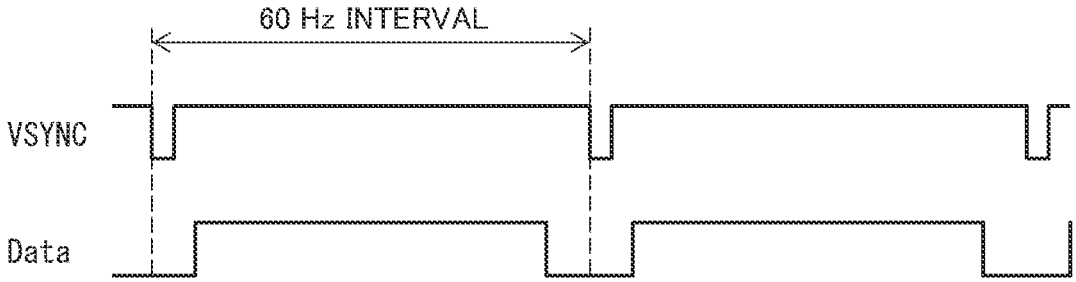
FIG. 9 is a timing chart illustrating an image data update timing in a known display device.
Figure 10A:
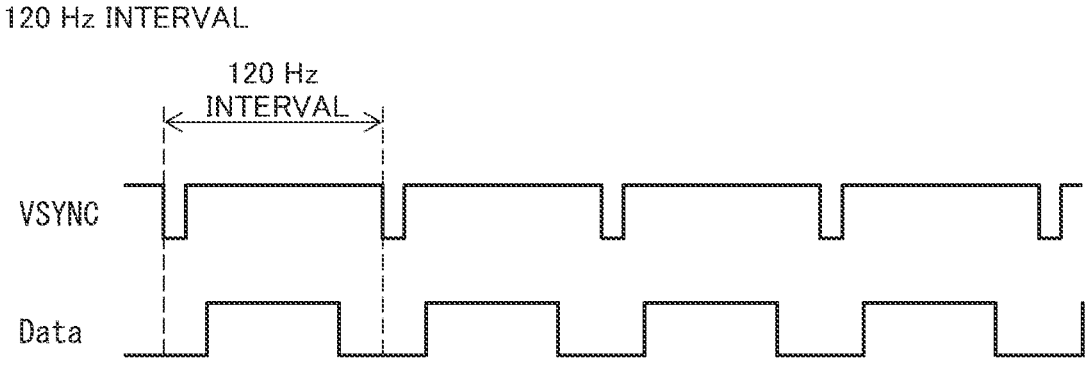
FIGS. 10A and 10B are timing charts illustrating image data update timings in the known display device.
Figure 10B:
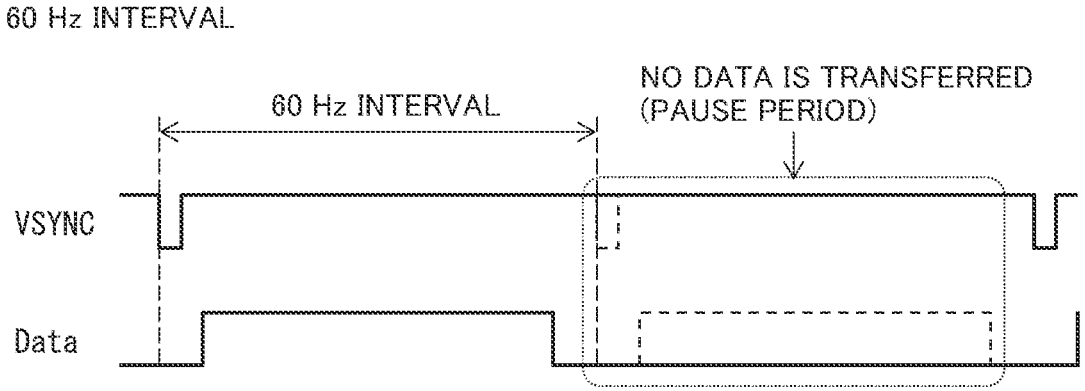
Figure 11:
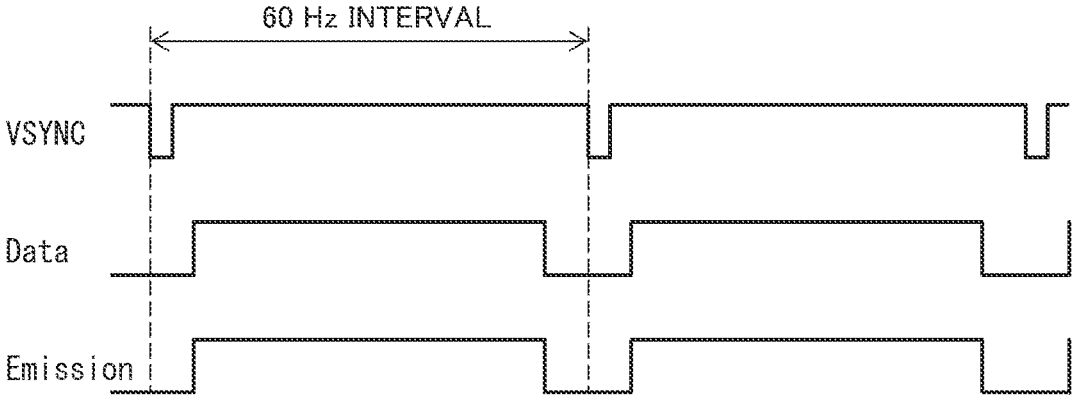
FIG. 11 is a timing chart illustrating an example in which a light-emission timing is added to the image data update timing in the display device illustrated in FIG. 9.
Figure 12A:
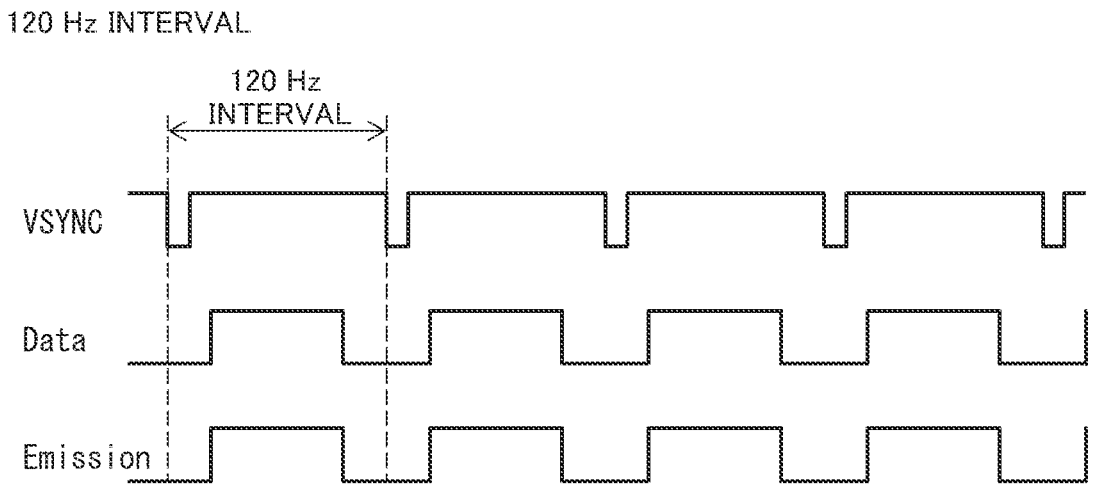
FIGS. 12A and 12B are timing charts illustrating examples in which light-emission timings are respectively added to the image data update timings in the display device which are illustrated in FIGS. 10A and 10B.
Figure 12B:
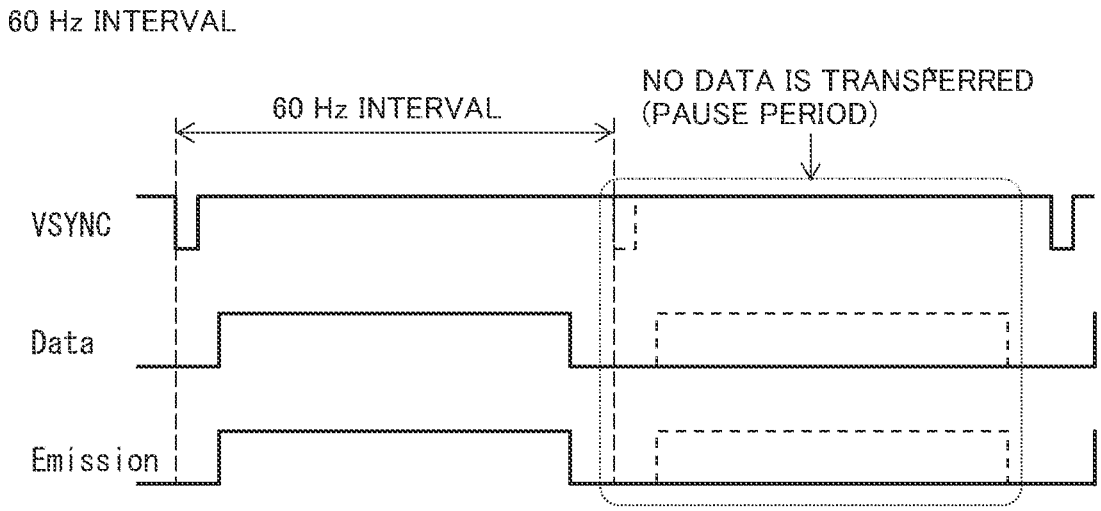

FIG. 8 is a flowchart illustrating a flow of frame-rate setting processing in the fourth frame-rate setting unit 26 in the display device 4 illustrated in FIG. 7. The frame-rate setting processing is assumed to be executed before the first step (S11) in the flowchart (FIG. 3) used in the description of the first embodiment is performed.

In this case, for each application, the upper-limit value of the frame rate at which the display panel 101 performs image display when the application is executed has been pre-set. For example, for an application for a racing game or the like in which movements are very quick, high performance is needed, and thus the 120 Hz frame rate is set for the upper-limit value, and for an application for a quiz game or the like in which image changes are relatively small, high performance is not needed, and thus the 60 Hz frame rate is set for the upper-limit value.

First, based on the determination result sent from the application execution determining unit 701, the fourth frame-rate setting unit 26 determines whether or not an executed-application identification signal is received (S41). Upon receiving the executed-application identification signal, the fourth frame-rate setting unit 26 sets an upper-limit frame rate according to an application that is executed and then ends the processing (S42).

Although, in the flowchart, the upper-limit value of the frame rate pre-set for each application is automatically set for the upper-limit value of the frame rate set by the first frame-rate setting unit 22, the present disclosure is not limited thereto. For example, the upper-limit value of the frame rate may be determined by measuring the update timing of image data when an application is executed for the first time and be stored, and when the application is executed for the second time, the stored upper-limit value may be automatically set for the upper-limit value of the frame rate set by the first frame-rate setting unit 22.

Alternatively, the user may set the upper-limit value of the frame rate for each application that is used. In addition, the creator of each application may pre-determine the upper-limit value of the frame rate.

Although an example in which the display device 4 is included in an information portable terminal, such as a smartphone, that can execute an application has been described in the present embodiment, the display device 4 may be applied to not only such an information portable terminal but also any electronic equipment that can execute an application.

Although the setting of the upper-limit value of the frame rate has been described in detail in each embodiment described above, and the lower-limit value of the frame rate has been described as being 60 Hz, the lower-limit value is not limited thereto. In the present embodiment, the lower-limit value of the frame rate may be determined according to the type of display panel 101. For example, when the display panel 101 is an OLED, the frame rate can be reduced to 30 Hz, and when the display panel 101 is a liquid-crystal panel using an oxide semiconductor, the frame rate can be reduced to 1 Hz.

One aspect of the present disclosure is not limited to each embodiment described above. One aspect of the present disclosure can be applied to variable frame-rate display devices, can further be applied to electronic equipment, such as personal computers, that includes such display devices, and can be particularly applied to portable electronic equipment, smartphones, notebook computers, game equipment, and so on in order to provide an advantage of reducing the power consumption. [Implementation Examples Using Software]

Control blocks (particularly, the first frame-rate setting unit 22, the second frame-rate setting unit 24, the third frame-rate setting unit 25, and the fourth frame-rate setting unit 26) in the display control units 201 to 204 and the light-emission control unit 27 may be implemented by a logic circuit (hardware) formed in an integrated circuit (an IC chip) or the like or may be implemented by software by using a central processing unit (CPU).

In the latter case, the first frame-rate setting unit 22, the second frame-rate setting unit 24, the third frame-rate setting unit 25, the fourth frame-rate setting unit 26, and the light-emission control unit 27 include a CPU that executes instructions from a display control program that is software for realizing the functions, a read-only memory (ROM) or a storage device (which are hereinafter referred to as a "recording medium") to which the display control program and various types of data are recorded so as to be readable by a computer (or a CPU), a random-access memory (RAM) to which the display control program is loaded, and so on. A computer (or a CPU) reads the display control program from the recording medium and executes it to thereby realize both suppression of a reduction in display quality and a reduction in power consumption of a display device including a light-emitting unit. The recording medium can be implemented by a "non-transitory tangible medium", for example, a tape, a disc/disk, a card, a semiconductor memory, a programmable logic circuit, or the like. The display control program may also be transmitted to the computer over an arbitrary transmission medium (such as a communications network or a broadcast radio wave). One aspect of the present disclosure can also be realized in the form of data signals obtained by electronically transmitting the display control program over a carrier wave.

[Brief Summary]

A display control device according to aspect 1 of the present disclosure is a display control device for controlling a display panel that includes a light-emitting unit and that displays image data. The display control device includes: a light-emission control unit that controls a light-emission timing of the light-emitting unit; and an image-data update control unit that controls an update timing of the image data independently from the control of the light-emission timing.

A display control device according to aspect 2 of the present disclosure may have a configuration in which, in aspect 1 described above, the light-emission control unit causes the light-emitting unit in the display panel to emit light at a timing at which the image-data update control unit does not update the image data.

A display control device according to aspect 3 of the present disclosure may have a configuration in which, in aspect 1 or 2 described above, the light-emission control unit causes the light-emitting unit in the display panel to emit light at a predetermined cycle.

A display control device according to aspect 4 of the present disclosure may further include, in one of aspects 1 to 3 described above, an image-data update determining unit that determines whether or not there is an update in externally supplied image data in each pre-set image update period; and the image-data update control unit may include a first frame-rate setting unit that sets a frame rate in accordance with a determination result of the image-data update determining unit to cause the display panel to perform image display through switching between at least two types of frame rate.

A display control device according to aspect 5 of the present disclosure may have a configuration in which, in aspect 4 described above, the image-data update determining unit determines whether or not there is an update, based on image data stored in an image-data storage unit in which image data that is supplied externally and that is to be transferred to the display panel is stored.

A display control device according to aspect 6 of the present disclosure may have a configuration in which, in aspect 4 or 5 described above, when the image-data update determining unit determines that there is no update in the image data, the first frame-rate setting unit sets the frame rate to a frame rate that is lower than a frame rate at a time of a previous image-update determination.

A display control device according to aspect 7 of the present disclosure may have a configuration in which, in one of aspects 4 to 6 described above, the image-data update control unit further includes a second frame-rate setting unit with which a user sets an upper-limit value of the frame rate; and the first frame-rate setting unit may set an upper-limit value of the frame rate to the upper-limit value set by the second frame-rate setting unit.

A display control device according to aspect 8 of the present disclosure may further include, in one of aspects 4 to 7, a remaining-battery-charge checking unit that checks remaining battery charge of electronic equipment including the display control device; the image-data update control unit may further include a third frame-rate setting unit that sets an upper-limit value of the frame rate in accordance with the remaining-battery-charge detected by the remaining-battery-charge checking unit; and the first frame-rate setting unit may set an upper-limit value of the frame rate to the upper-limit value set by the third frame-rate setting unit.

A display control device according to aspect 9 of the present disclosure may have a configuration in which, in one of aspects 4 to 8, for each application executed in electronic equipment including the display control device, an upper-limit value of the frame rate at which the display panel performs image display when the application is executed may be set; the display control device may further include an application execution determining unit that determines the application that is executed; the image-data update control unit may further include a fourth frame-rate setting unit that sets an upper-limit value of the frame rate in accordance with the application that is executed; and the first frame-rate setting unit may set an upper-limit value of the frame rate to the upper-limit value set by the fourth frame-rate setting unit.

A display control method according to aspect 10 of the present disclosure is a display control method that causes a display panel to display an image through switching between at least two types of frame rate. The display control method includes: an image-data update determining process of determining whether or not there is an update in externally supplied image data in each pre-set image update period; and a frame-rate setting process of setting a frame rate in accordance with a determination result of the image-data update determining process.

The light-emission control unit and the image-data update control unit according to each aspect of the present disclosure may be realized by a computer. In this case, a control program for causing the computer to operate as individual units (software elements) included in the light-emission control unit and the image-data update control unit to thereby cause the computer to realize the light-emission control unit and the image-data update control unit and a computer-readable recording medium that stores therein the control program are also encompassed by the scope of the present disclosure.

The present disclosure is not limited to the embodiments described above, and various changes are possible within the scope recited in the appended claims. Embodiments obtained by appropriately combining the technical means respectively disclosed in the different embodiments are also encompassed by the technical scope of the present disclosure. In addition, new technical features can be realized by combining the technical means respectively disclosed in the embodiments.

One aspect of the present disclosure can be applied to display devices that control display panels that have light-emitting units and that display image data, can be applied to electronic equipment including such display devices, and can be particularly applied to battery-operated electronic equipment of those pieces of electronic equipment. Examples of the battery-operated electronic equipment include portable information terminals, such as smartphones. While there have been described what are at present considered to be certain embodiments of the invention, it will be understood that various modifications may be made thereto, and it is intended that the appended claims cover all such modifications as fall within the true spirit and scope of the invention.

The present disclosure contains subject matter related to that disclosed in Japanese Priority Patent Application JP 2020-028662 filed in the Japan Patent Office on Feb. 21, 2020, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display control device for controlling a display panel that includes a light-emitting unit and that displays image data, the display control device comprising:

a light-emission control unit that controls a light-emission timing of the light-emitting unit, wherein the light-emission control unit causes a spontaneous light-emitting element in the light-emitting unit to emit light at a predetermined cycle and regular intervals regardless of whether a pause period in which the image data is not transferred to the display panel or a non-pause period in which the image data is transferred to the display panel.

2. The display control device according to claim 1, further comprising:

an image-data update control unit that controls an update timing of the image data independently from the control of the light-emission timing, wherein the light-emission control unit causes the light-emitting unit in the display panel to emit light at a timing at which the image-data update control unit does not update the image data.

3. The display control device according to claim 1, wherein the light-emission control unit causes the light-emitting unit in the display panel to emit light at a predetermined cycle.

4. The display control device according to claim 1, further comprising:

an image-data update control unit that controls an update timing of the image data independently from the control of the light-emission timing; and an image-data update determining unit that determines whether or not there is an update in externally supplied image data in each pre-set image update period, wherein the image-data update control unit comprises a first frame-rate setting unit that sets a frame rate in accordance with a determination result of the image-data update determining unit to cause the display panel to perform image display through switching between at least two types of frame rate.

5. The display control device according to claim 4, wherein the image-data update determining unit determines whether or not there is an update, based on image data stored in an image-data storage unit in which image data that is supplied externally and that is to be transferred to the display panel is stored.

6. The display control device according to claim 4, wherein, when the image-data update determining unit determines that there is no update in the image data, the first frame-rate setting unit sets the frame rate to a frame rate that is lower than a frame rate at a time of a previous image-update determination.

7. The display control device according to claim 4, wherein the image-data update control unit further comprises a second frame-rate setting unit with which a user sets an upper-limit value of the frame rate; and wherein the first frame-rate setting unit sets an upper-limit value of the frame rate to the upper-limit value set by the second frame-rate setting unit.

8. The display control device according to claim 4, further comprising:

a remaining-battery-charge checking unit that checks remaining battery charge of electronic equipment including the display control device, wherein the image-data update control unit further comprises a third frame-rate setting unit that sets an upper-limit value of the frame rate in accordance with the remaining-battery-charge detected by the remaining-battery-charge checking unit; and the first frame-rate setting unit sets an upper-limit value of the frame rate to the upper-limit value set by the third frame-rate setting unit.

9. The display control device according to claim 4, wherein, for each application executed in electronic equipment including the display control device, an upper-limit value of the frame rate at which the display panel performs image display when the application is executed is set;

the display control device further comprises an application execution determining unit that determines the application that is executed;

the image-data update control unit further comprises a fourth frame-rate setting unit that sets an upper-limit value of the frame rate in accordance with the application that is executed; and the first frame-rate setting unit sets an upper-limit value of the frame rate to the upper-limit value set by the fourth frame-rate setting unit.

10. A display control method that controls a display panel, the display panel comprising a light-emitting unit and displaying image data, the display control method comprising:

causing a spontaneous light-emitting element in the light-emitting unit to emit light at a predetermined cycle and regular intervals regardless of whether a pause period in which the image data is not transferred to the display panel or a non-pause period in which the image data is transferred to the display panel.

11. A computer-readable non-transitory recording medium storing therein a display control program for causing a computer to function as the display control device according to claim 1, wherein the display control program causes the computer to function as the light-emission control unit and the image-data update control unit.

12. The display control device according to claim 2, wherein the light-emission control unit causes the light-emitting unit in the display panel to emit light at a predetermined cycle.

13. The display control device according to claim 2, further comprising:

an image-data update determining unit that determines whether or not there is an update in externally supplied image data in each pre-set image update period, wherein the image-data update control unit comprises a first frame-rate setting unit that sets a frame rate in accordance with a determination result of the image-data update determining unit to cause the display panel to perform image display through switching between at least two types of frame rate.

14. The display control device according to claim 3, further comprising:

an image-data update determining unit that determines whether or not there is an update in externally supplied image data in each pre-set image update period, wherein the image-data update control unit comprises a first frame-rate setting unit that sets a frame rate in accordance with a determination result of the image-data update determining unit to cause the display panel to perform image display through switching between at least two types of frame rate.

15. The display control device according to claim 12, further comprising:

an image-data update determining unit that determines whether or not there is an update in externally supplied image data in each pre-set image update period, wherein the image-data update control unit comprises a first frame-rate setting unit that sets a frame rate in accordance with a determination result of the image-data update determining unit to cause the display panel to perform image display through switching between at least two types of frame rate.

* * * * *